United States Patent [19]

Klein

[11] 4,197,592

[45] * Apr. 15, 1980

[54] SPORT GLOVE

[75] Inventor: Michael Klein, New York, N.Y.

[73] Assignee: Cluett, Peabody & Co., Inc., New York, N.Y.

[ * ] Notice: The portion of the term of this patent subsequent to Jun. 20, 1995, has been disclaimed.

[21] Appl. No.: 911,561

[22] Filed: May 31, 1978

Related U.S. Application Data

[63] Continuation-in-part of Ser. No. 807,045, Jun. 16, 1977, Pat. No. 4,095,292, which is a continuation-in-part of Ser. No. 724,395, Sep. 17, 1976, abandoned.

[51] Int. Cl.[2] ..... A41D 19/00

[52] U.S. Cl. ..... 2/161 A; 2/164

[58] Field of Search ..... 2/159, 161 R, 161 A, 2/164, 16, 160, 162, 163, 167, 169; 66/174

[56] References Cited

U.S. PATENT DOCUMENTS

| | | | |
|---|---|---|---|
| 1,538,263 | 5/1925 | Ackerman | 2/164 X |
| 1,571,860 | 2/1926 | Meyer | 2/164 X |
| 2,653,601 | 9/1953 | Morrison | 2/159 X |
| 2,842,771 | 7/1958 | Foti | 2/159 |
| 3,251,067 | 5/1966 | Shmikler | 2/169 |
| 3,342,182 | 9/1967 | Charos . | |
| 3,559,212 | 2/1971 | Skovron | 2/161 A |
| 3,885,249 | 5/1975 | De Brabander | 2/161 R |
| 3,934,582 | 1/1976 | Gorrie . | |
| 4,122,554 | 10/1978 | Stager | 2/164 |

FOREIGN PATENT DOCUMENTS

| | | | |
|---|---|---|---|
| 20845 | 12/1899 | Switzerland | 2/164 |
| 865247 | 4/1961 | United Kingdom | 2/161 R |

OTHER PUBLICATIONS

"Isotoner" Suggested Ad of Aris Glove Company.

*Primary Examiner*—Nile C. Byers, Jr.
*Assistant Examiner*—Moshe I. Cohen

[57] ABSTRACT

The disclosure relates to an improved sport glove construction comprising connected inner and outer glove shells of different constructions, each contributing significant and desirable characteristics to the combination. The inner glove is constructed of a highly elastic, stretchable material, so constituted as to be received tightly over the entire hand of the wearer, snugly enclosing and conforming to the individual fingers and thumb, as well as the palm and back areas of the hand. The construction of the elastic inner glove shell is such as to provide a secure yet comfortable feel to the glove. The elastic inner glove is entirely enveloped by a second or outer glove of a material and construction selected to provide appropriate gripping and other characteristics. The outer glove may be of a somewhat elastic material, such as knitted fabric, but may also be of a relatively nonelastic material, such as leather, vinyl or the like, or may be a combination of materials. The inner and outer glove shells are attached in a manner permitting the necessary degree of elastic expansion of the inner glove shell relative to the outer shell when the glove is applied to the hand.

4 Claims, 11 Drawing Figures

SPORT GLOVE

RELATED APPLICATIONS

This application is a continuation-in-part of my prior copending application Ser. No. 807,045 filed June 16, 1977, now U.S. Pat. No. 4,095,292, which is a continuation-in-part of my prior application Ser. No. 724,395, filed Sept. 17, 1976, now abandoned.

BACKGROUND AND SUMMARY OF THE INVENTION

Sport gloves of the type concerned herein are utilized in a wide variety of activities, such as golf, baseball, tennis driving, etc. The function of such gloves is twofold: to improve the grip of the hand to the object, and also to protect the hand of the wearer. Early designs of sport gloves typically were constructed of leather or leather-like material, which has certain significant disadvantages. Among these are that the material may deteriorate quickly under service conditions, which include exposure to perspiration of the hand. Additionally, such gloves typically are required to be provided in a wide variety of sizes, in order to fit the wide range of hand sizes with reasonable comfort and effectiveness.

One of the early efforts to overcome the disadvantages of leather or leather-like sport gloves construction is reflected in the Scherr U.S. Pat. No. 2,907,046, for example. The glove of the Scherr patent is of knitted construction, comprising a blend of stretchable and non-stretchable yarns, and is arranged to fit snugly on the hand of the wearer. Because of the somewhat slick or slippery nature of the snug-fitting, stretchable glove, a leather or other appropriate gripping surface is secured onto the palm area of the glove, with individual strips of leather extending along the gripping areas of the finger and thumb stalls. The objective of the glove construction of the Scherr patent is to combine the desired gripping qualities of leather or the like with the snug-fitting characteristics of a knitted, elastic glove.

A minor modification of the glove of the Scherr patent is reflected in the Stanton U.S. Pat. No. 3,597,765. The glove of the Stanton patent comprises a stretchable, elastic glove, provided, in the same manner as the Scherr patent, with sewed-on leather surfacing in the gripping areas. In the Stanton patent, there are individual strips of facing material which extend along the finger and thumb sections and on down into the palm area of the glove, so that the palm area is provided with friction surfacing in strip form, rather than covering the entire palm area as in the Scherr patent.

Although the glove of the Scherr U.S. Pat. No. 2,907,046 represented an improvement over previous constructions, both it and the modification thereof reflected by the Stanton patent have certain limitations sought to be avoided by the present invention. For example, the surfacing material is effectively limited to small strip-like areas, in order to realize the elastic characteristics of the basic glove construction. This introduces important limitations from the standpoint of styling and appearance and also can reduce or limit overall gripping effectiveness. Additionally, the stretchable, elastic glove has limited warming characteristics, reducing its desirability for some fall and winter sports.

In accordance with the present invention, a novel and improved form of sport glove is provided, which utilizes the desirable features of a stretchable, elastic glove, as reflected in the Scherr patent, for example, yet which at the same time has improved functional and styling characteristics. To this end, the sport glove of the present invention incorporates inner and outer complete glove shells, each of different but complementary characteristics. The inner glove is constructed of a stretchable, elastic knitted material, while the outer shell is constructed of a material or combination of materials having the desired gripping, styling and other characteristics. The two glove shells, while securely connected, are arranged to accommodate a significant degree of independent movement, especially if the outer glove shell is constructed in whole or in part of a relatively inelastic material.

Pursuant to the invention, the materials and the constructions of the inner glove shell are chosen to provide a snug overall fit, so that the hand of the wearer is rather tightly confined yet not constricted against required movements. In this respect, sufficient contraction of the inner glove shell about the hand, fingers and thumb to provide a slight "tingly" sensation in the hand has been found to be popular. The tightness should not, of course, be such as to impair good circulation.

In the glove of the invention, the outer glove shell is selected without significant regard for snugness of fit around the hand, and almost exclusively with regard to independent characteristics, such as gripping capability, appearance, warmth (in the case of sport gloves intended for winter sports), or the like. The outer glove shell may be of a stretchable construction (e.g., a knitted fabric), but in such cases the stretchability of the outer glove shell is not relied upon significantly to achieve the desired tight conformity and snugness of the overall glove of the wearer's hand. The function of snugness is derived substantially if not exclusively from the inner glove shell and, insofar as the outer glove may contribute snugness by its stretchability, this is a secondary consideration. Indeed, in some of the constructions of the new sports glove, the outer glove shell will be formed of materials, such as leather or vinyl, which are clearly of a non-stretchable and nonelastic nature. In other advantageous constructions of the new glove, the outer shell may be formed of combinations of different materials, to achieve a combination of optimum functions. For example, the outer glove may have a body formed of a knitted material, for warmth and attractiveness, in conjunction with materials such as surfacing of leather or vinyl in selected areas, for improved gripping.

In accordance with a significant feature of the invention, a dual-shell sport glove is provided which comprises a tight-conforming, elastic, stretchable inner shell and a somewhat looser fitting, friction-gripping outer shell, wherein the inner and outer shells are secured together in a manner sufficient to maintain the unitary integrity of the dual-shell construction, while at the same time accommodating such relative expansion and contraction and relative movement as is necessary in the normal utilization of the glove. To advantage, the inner and outer glove shells are secured at least at the tips of the thumb and finger stalls and along at least a portion of the cuff area. In some cases, attachment may also be made at the quirks of the finger stalls and also along one side area. In those cases where the outer glove shell has limited stretch characteristics, the areas of attachment between the inner and outer shells are correspondingly limited, to accommodate greater relative distension of the inner glove shell when the dual glove is applied to the hand; however, where the outer glove shell has far greater stretch characteristics (e.g. where the outer shell is formed of a knitted or stretch material), the attachment between the inner and outer glove shells can be more comprehensive.

In accordance with one aspect of the invention, the outer glove shell may be formed of a combination of materials, to achieve desired styling, gripping and other characteristics. By way of example, the outer glove shell may be formed of a stylish and attractive knitted material, such as orlon which, by itself, may have less than wholly adequate gripping characteristics. In such cases, strips or other forms of surfacing material may be applied to appropriate areas of the outer glove shell to enhance the gripping action. Inasmuch as the outer glove shell is not relied upon for its stretch characteristics, a wide latitude is possible in the form, location and character of grip-enhancing materials.

For a better understanding of the above and other features and advantages of the invention, reference should be made to the following detailed description of a preferred embodiment, and to the accompanying drawing.

DESCRIPTION OF PREFERRED EMBODIMENTS

Figure 1:
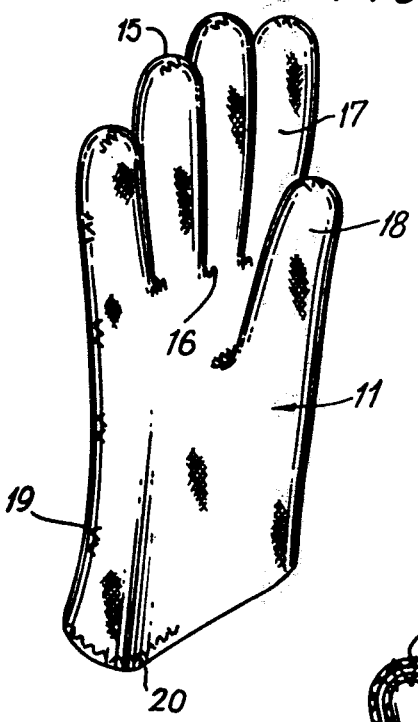
FIG. 1 is a perspective view of one form of a dual-shell sport glove constructed in accordance with the principles of the invention.

Referring now to the drawing, the new sport glove is shown to comprise separate inner and outer glove shells 10, 11 respectively. The individual glove shells are securely attached one to the other, as will be more fully described, while providing for a substantial degree of independent movement of one with respect to the other.

Pursuant to the invention, the inner glove shell 10 is formed of a highly elastic, stretchable material. Among those materials suitable for the purpose is a knitted tricot material comprised of a blend of nylon and spandex yarns. Such materials are widely used and readily available from standard mill sources at attractive prices. A commonly used nylon-spandex blend may be on the order of 20% spandex yarns, 80% nylon yarns. 40 denier yarns are suitable for the purposes of the present invention. It will be understood, of course, that neither the specific yarns nor the specific material is deemed critical to the invention. However, the specified characteristics of elasticity, stretchability and the like are representative of the characteristics generally desired for the inner shell 10.

Because of the rather substantial stretchability of the inner glove shell 10, one, or at least a few, basic inner shell sizes can accommodate the normal spectrum of hand sizes.

Although the specific construction of the inner glove shell 10 is not significant to the invention, the shell typically may be formed by first cutting a double panel section, comprising the entire glove exclusive of the thumb stall. That section is hemmed along the cuff and along the confronting edges. A separate thumb stall, cut separately, is secured to the body of the glove along the seam 14.

Sizing of the inner glove shell 10 is largely a function of merchandising approach and of the character of the outer glove shell 11, as will more fully appear. Thus, in places where a relatively few sizes of inner shells are to be provided for the entire spectrum of hand sizes, a reasonable amount of stretch may be provided for in both length and width directions. However, in cases where a larger variety of sizes of inner shells are to be utilized, a lesser degree of stretch may be provided, particularly in the length direction. In either case, the amount of stretch to be provided is a function of comfort to the wearer. It is popular to provide a sufficiently snug fit to achieve a slight "tingle" in the hand and fingers, while at the same time neither unduly restricting blood circulation or inhibiting free use of the hand.

Pursuant to the invention, rather than securing a surfacing material to the palm and finger area of the elastic shell 10, the glove of the invention incorporates a full outer glove shell 11, which completely encloses and totally conceals the inner shell 10. The outer glove shell 11 may be formed of a wide variety of materials or combinations of materials, but should exhibit the desired wear and frictional gripping characteristics sought for in a sport glove. Among the materials suitable for the purpose are, of course, leather and vinyl. In addition, a number of knitted fabrics are available which exhibit effective gripping characteristics, particularly if combined with other materials as hereinafter described. Among these are fabrics constructed of wool, acrylic, cotton or nylon. Within the contemplation of the present invention, practically any material, stretchable or non-stretchable, that has an acceptable exterior glove surface for the purpose intended can be utilized as the outer shell.

Where the outer glove shell 11 is of knitted construction, it may, of course, be of a size and shape to provide for some degree of expansion when applied to the hand of the wearer. However, this is not a necessary or principal characteristic of the outer glove shell 11 and, indeed, is not intended as a substitute for the tight fitting, contractile characteristic of the elastic inner glove shell 10. Thus, with a typical loose-knit construction, the outer glove shell 11 will easily expand to receive the hand of the wearer, without any significant degree of resistance or without any particular feeling of tightness or snugness about the hand of the wearer. Of course, where the outer glove shell 11 is constructed of a material such as leather or vinyl, which is essentially nonelastic in character, the outer glove shell is properly sized in the first instance to receive a given size of hand. Whether the outer shell is of a knitted, and therefore somewhat stretchable, character or of a relatively non-stretchable material such as vinyl or leather, the outer glove shell will be proportioned to a "normal" size, taking into consideration the presence internally of the elastic inner glove shell 10.

Pursuant to a preferred and primary aspect of the invention, the inner and outer glove shells 10, 11 are connected together at limited areas, sufficient to assure that the inner shell 10 remains properly oriented and disposed within the outer shell, but at the same time accommodating substantial relative elastic movement and adjustment of the inner shell relative to the outer shell. In the form of the invention illustrated in FIGS. 1–3, the inner and outer shells are attached to each other specifically at the tips 15 of the fingers and thumb, and also at the quirk or crotch areas 16 between fingers. The specific nature of the attachment is not significant to the invention, although it should be generally unobtrusive, but sufficiently secure to permit insertion of the fingers into and removal from the finger stalls 17 and thumb stalls 18 of the elastic inner shell 10, while retaining the integrity of the limited attachment points. The dual-shell glove assembly of FIGS. 1–3 also provides for attachment of the shells at a plurality of points 19 along one side of the glove, most advantageously along the little finger side as reflected in FIG. 2, and also along a portion of the cuff, as indicated at 20.

In general, the manner of attachment of the inner and outer glove shells 10, 11 is such as to assure the retention of the separate shells in a preassembled relationship at the fingers and at the cuff. Accordingly, during donning and doffing of the glove, the wearer need not treat the dual-shell assembly as being comprised of two separate and somewhat independent shells, but can manage the glove largely as if it were a more conventional lined glove. However, and as a significant aspect of the invention, the construction of the glove differs significantly from a conventional lined glove in that a substantial independent elastic expansion and contraction of the inner shell is provided, at least in the transverse or circumferential direction. As reflected in FIG. 3, for example, the respective shells 10, 11 may be secured together in the cuff areas around less than the entire circumference of the cuff and/or are rather loosely "tacked" together, so that the elastic inner shell 10 can undergo significant circumferential expansion independently of the outer shell. In some cases, where the outer shell 11 is of knitted construction and has a substantial stretchability in its own right the outer shell may be permitted to expand and contract in the cuff area along with the elastic inner shell. However, where the outer shell 11 is of a relatively non-stretchable material such as leather or vinyl, the shells should be secured together at more widely spaced points, and/or over only a fraction of the circumference, to accommodate differential contracting and expanding movements. By appropriately spacing the points of attachment between the elastic inner shell 10 and a relatively non-stretchable outer shell 11, the material of the outer shell may be arranged and caused to gather in accordion fashion while the inner shell 10 contracts elastically.

In the form of the invention shown in FIGS. 4–7, the outer shell of the dual-shell sport glove is of a composite construction in order to achieve a combination of optimum characteristics. The contractile inner glove shell 30 is formed of a material and has the structural characteristics as described in connection with the embodiment of FIGS. 1–3. In the second-illustrated modification of the invention, the inner glove shell 30 is secured to the outer shell 31 at the tips 32 of the finger and thumb stalls and around the cuff 33 of the inner shell.

In the embodiment of FIGS. 4–7, the outer glove shell 31 is formed of a combination of materials and includes a shell body 32 formed of materials and of a construction selected primarily for characteristics of attractive styling, warmth, or the like, but not necessarily having optimum gripping characteristics. To greatest advantage, the shell body 32 is of a knitted construction, and thus inherently has a relatively high degree of expandability and contractability. Nevertheless, it is to be understood that the characteristics of the outer shell body 32 are not relied upon primarily to provide tight-fitting conformity to the hand. The contractile inner shell 30 serves that primary purpose. However, since the outer shell body 32 will have a reasonable degree of expansion and contraction capability, it is feasible to secure the cuff area 33 of the contractile inner shell 30 throughout its full circumference to the outer shell body 32, as by means of a line of relatively loose stitching 34.

Figure 6:
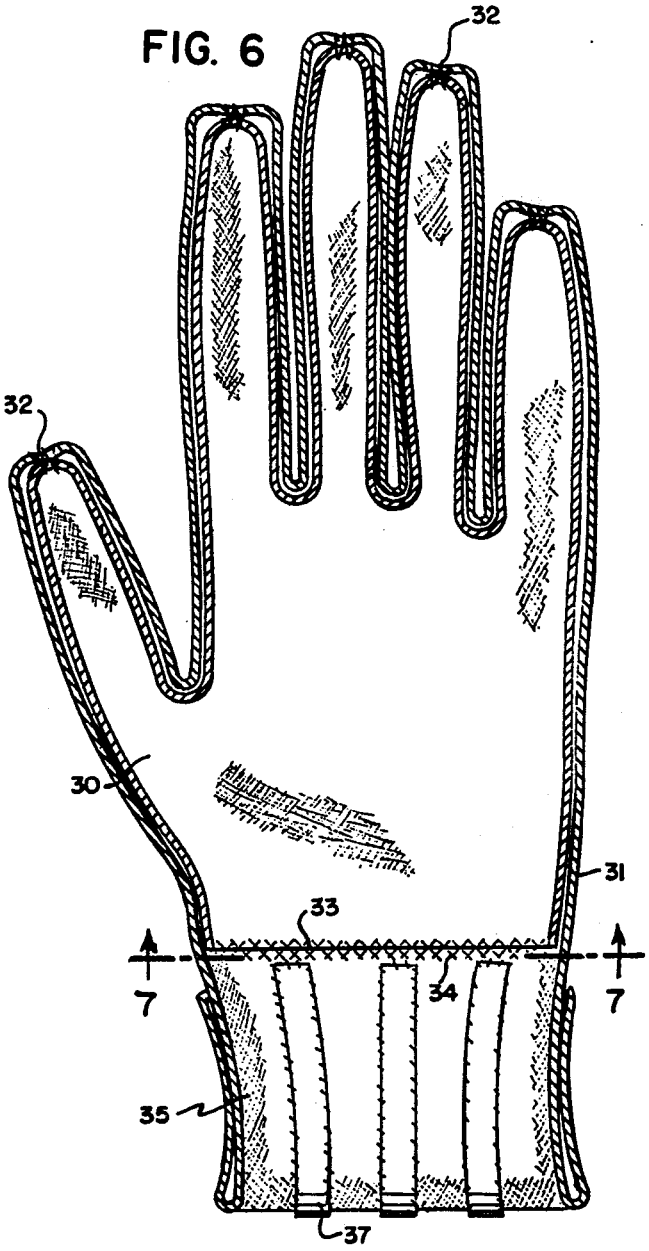
FIG. 6 is a plan view of the front of the glove of FIG. 4.
Figure 5:
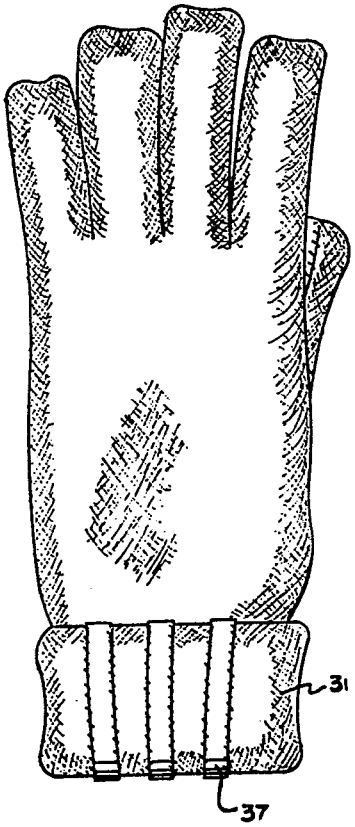
FIG. 5 is a plan view of the back of the glove of FIG. 4.

As reflected in FIGS. 5 and 6, the outer shell body 32 may be formed with a cuff area 35 which extends beyond the cuff 33 of the inner shell for both styling and comfort. In the illustrated arrangement, the cuff of the contractile inner shell 30 may be located close to the base of the thumb, in the region at which the hand narrows sharply to the dimensions of the wrist. The cuff 35 of the outer shell body may extend well beyond that point to provide a more attractively styled glove, as well as to provide protection of the wrist area. The specifically illustrated form of glove is provided with a cuff 35 which is sufficiently long to have a floded back margin 36 forming a double cuff. Strips 37 of vinyl or leather, for example, may be secured to the cuff area for styling purposes.

The outer shell body 32, being of a construction and of a material selected primarily for optimum characteristics other than gripping, is provided with means for grip enhancement in the significant areas. To this end, elongated strips 38 of leather, vinyl or other high friction material may be sewn along the front faces of the finger and thumb stalls, and additional strips 39 of similar material may be sewn to extend diagonally along the face of the palm area. In the specific form of the invention illustrated in FIGS. 4–7, the grip enhancing strips 38, 39 are relatively long and narrow, and the strips 38 extending along the faces of the thumb and finger stalls generally terminate at the bases of the stalls. However, particularly since the outer shell body 32 is not relied upon for elastic, contractile function, the particular form and nature of the grip enhancing areas is not critical. In other words, the sought-for characteristics of the outer shell body are not significantly interferred with by application of the grip enhancing elements 38, 39. By way of contrast, attachment of such strips directly to a contractile shell, such as the inner shell 30, would tend to interfere with the contractile properties of the shell.

FIGS. 8–11 illustrate alternate forms which the glove of the invention may assume. As described in connection with the previous embodiments, it is perhaps preferable that the outer glove shell and the inner glove shell be attached loosely and at spaced apart selected areas. This is done in order to maximize the independence of the inner glove shell with respect to any restraint which might be imposed upon its ability to expand and contract when warm. However, in the embodiments of FIGS. 8–11, a more general or overall attachment has been illustrated between the outer shell which in each case is, for example, made of a knitted or stretch material which is expandable and contractile sufficiently so that when attached as illustrated and described to the inner glove shell, it does not significantly impede the latter from expansion or contraction.

Figure 8:
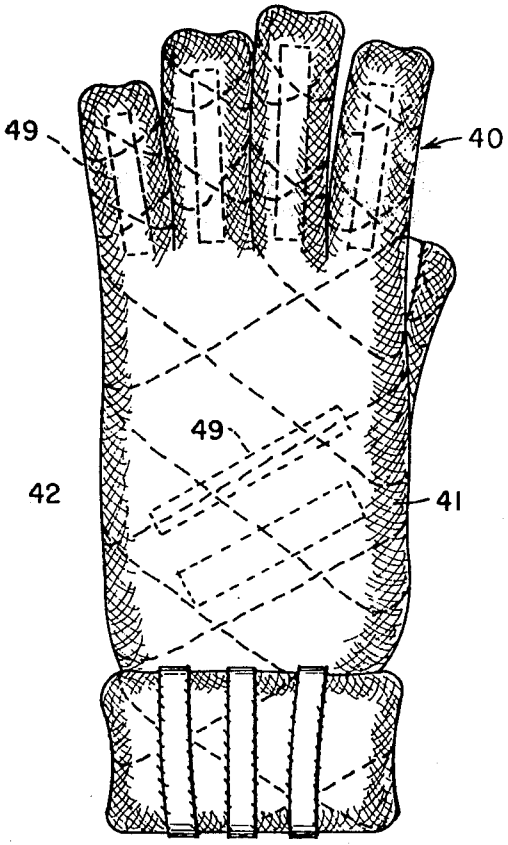
FIG. 8 is a plan view of the back of a glove illustrating an alternate construction.

Accordingly, FIG. 8 illustrates the back of a glove 40 whose outer shell 41 is constructed of a knitted or stretch material. Although not shown, the front of the finger stalls and the palm area are preferably provided with overlying strips 49 of a high friction material in the manner illustrated in connection with the embodiment of FIG. 4. The outer shell 41 will be connected to the inner spandex glove shell by stitching 42 which more comprehensively joins the outer and inner glove shells together than in previous embodiments.

Figure 9:
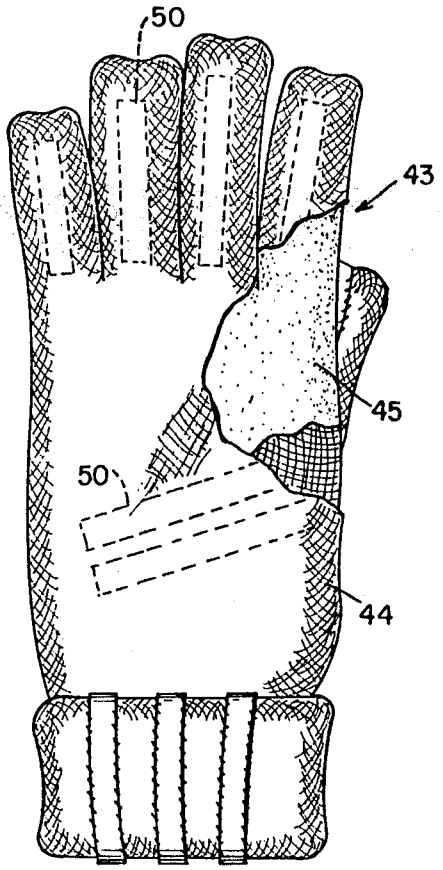
FIG. 9 is a plan view partially broken away of the back of a glove of yet another alternate construction.

FIG. 9 discloses a glove 43 whose outer shell of knitted or stretch material 44 is suitably bonded by an adhesive 45 to the inner glove shell of spandex material. Overlying high-friction strips 50 are provided on the finger stalls and palm area. In this configuration, even though the attachment may be said to be total, it will be understood that the outer shell 44 will be made of knitted or stretch material such that it will move in expansion and contraction substantially without impeding these characteristics of the inner glove shell.

Figure 10:
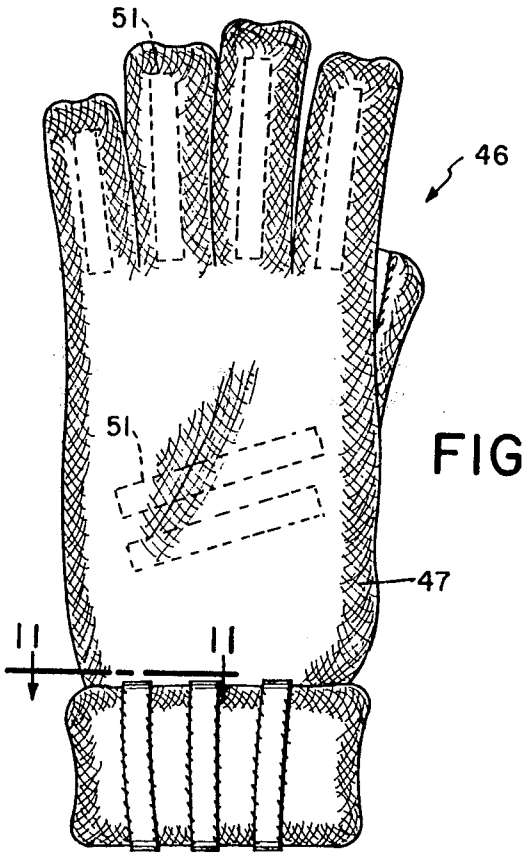
FIG. 10 is a plan view of the back of a glove of another construction.
Figure 11:
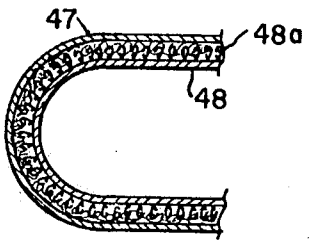
FIG. 11 is a partial cross section taken in the direction of arrows 11—11 of FIG. 10.

FIGS. 10 and 11 illustrate a glove 46 whose outer shell 47 is again of a stretch or knitted material (having overlying high-friction strips 51) which may be secured to the inner spandex glove shell 48 by hook-like members 48*a*. Such hook-like members can be formed by subjecting the outer surface of the inner glove shell 48 to abrasion causing large numbers of surface nylon filaments thereto to be broken and to curl in a hook-like fashion. By the proper selection of material for the outer glove shell, that is to say, the selection of a material having appropriate interstices, sufficient numbers of hook-like members 48*a* will engage such interstices to effect an attachment between the outer glove shell 47 of the inner spandex glove shell 48.

The dual-shell sport glove of the invention represents a significant improvement over prior art gloves utilizing snug-fitting, elastic coverings, in that the glove of the invention provides for both improved appearance and improved performance characteristics. Thus, whereas popular prior art gloves utilize a limited area friction surfacing secured directly on the palm and finger surfaces of the contractile shell, the glove of the present invention permits the use of a totally enclosing exterior glove shell, which can be both attractive in appearance, superior in a functional sense, and entirely competitive in manufacturing expense with the earlier types of glove.

Although the inner and outer glove shells of the applicant's dual-shell construction are secured together sufficiently to act essentially as a single glove during donning and doffing, the fact that the inner and outer shells each are complete gloves enables the securement of one to the other to provide for sufficient independence to freely accommodate the necessary relative expansion and contraction of the highly elastic inner shell. Thus, in securing the inner and outer shells together in the several ways described, the hand may enter and be released from the glove substantially as if it were a single, lined glove of conventional construction. At the same time, the functional characteristics of the inner and outer glove shells are designed to be critically different, with the inner shell providing for significant elastic expansion and contraction, but without regard to gripping or other characteristics, and the outer shell providing desired gripping characteristics, attractive appearance, etc. without regard to the contractile properties of the elastic inner shell. The construction of the invention enables an extremely wide variety of materials and designs to be utilized in the forming of the outer glove shell, including knitted materials, leather, vinyl, etc. Where the outer shell material is expandable and contractable, as in the case of a knitted construction, for example, the outer shell may be more closely attached to the inner shell, so as to expand and contract therewith, but it is not designed or utilized in a significant way for contractile properties.

The dual-shell glove of the invention, although by no means limited to the use in conjunction with winter sports, has an additional advantage for such purpose by reason of the two-layer construction. Because of its relatively lightweight construction, and its tight conformity to the hand, the contractile inner shell has limited warmth retaining properties. Thus, conventional gloves utilizing strip style friction surfacing, secured directly to an overall shell of elastic, tight-conforming material, provide rather limited protection against low temperatures. With the applicant's construction, on the other hand, the outer shell entirely envelopes the contractile inner shell. As a result, substantial heat retention properties may be constructed into the glove, not only by taking advantage of its two-layer construction but also by reason of the greater freedom in the selection of materials for the outer shell.

The many advantages derived from the applicant's sport glove construction are realized without significant additional manufacturing expense. In general, the outer glove shell may be constructed in accordance with well known and conventional techniques, and the assembly thereof with the contractile inner shell is easily and quickly accomplished, because of the relatively limited nature of the securement.

Figure 2:
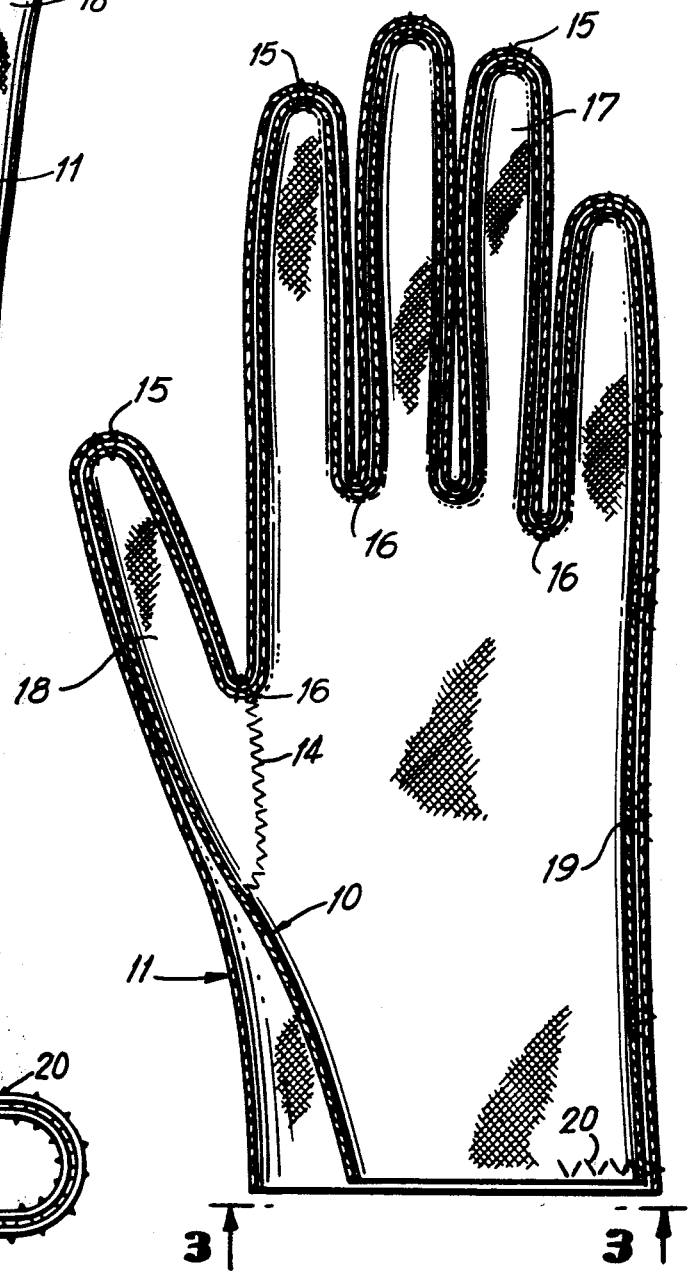
FIG. 2 is a cross sectional view through the principal plane of the glove of FIG. 1, illustrating details of its construction and of the attachment of the inner and outer glove shells.
Figure 3:
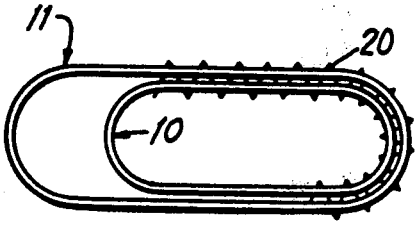
FIG. 3 is an elevational view, looking at the open end of the glove of FIG. 1.
Figure 4:
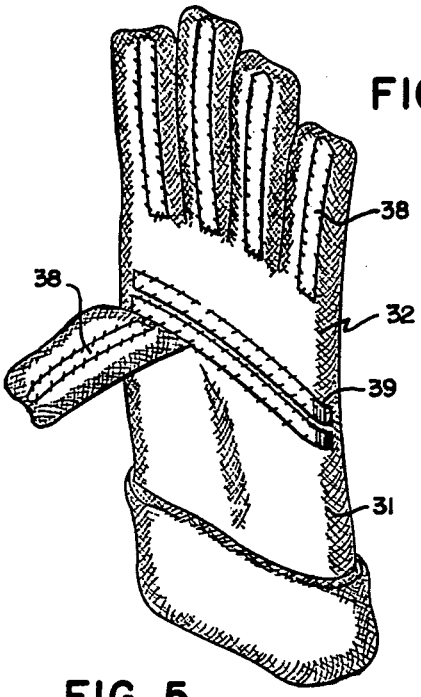
FIG. 4 is a perspective view of the new dual-shell sport glove, in which the outer glove shell is formed of a combination of materials.
Figure 7:
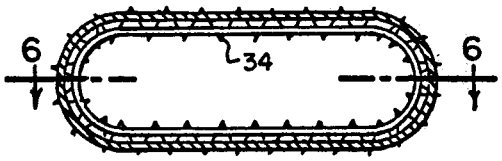
FIG. 7 is a cross sectional view as taken on line 7—7 of FIG. 6.

In the form of the invention shown in FIGS. 1–3, the outer glove shell, in addition to its other characteristics, has appropriate gripping characteristics for the purpose intended. In the modification of FIGS. 4–7, however, the outer glove shell is selected to have primary characteristics other than gripping, such as attractive styling, warmth, comfort, etc., and additional surfacing materials are provided to enhance the gripping action of the glove as a whole. In each of the illustrated embodiments, the inner glove shell is utilized for its contractile characteristics, without regard to gripping, and the outer glove shell (including facing strips, if any) serves primarily to provide desired gripping characteristics, without regard to contractile properties. Even where the outer glove shell is of knitted, and therefore of somewhat expandable and contractable construction, it is not relied upon significantly as a means for achieving a tight fit on the hand, but is designed and constructed primarily for other properties. Where the outer glove shell is formed of a combination of materials, even the outer shell body itself may be selected without primary regard to gripping characteristics, and surfacing materials may be applied for grip enhancement. The application of such surfacing materials, whether in strip form or otherwise, does not tend to compromise the contractile characteristics of the glove, as in the prior art patents mentioned hereinabove, because it is secured to the outer shell and not to the contractile inner shell. Accordingly, the glove of the invention combines superior functional characteristics with regard to tight, close conforming fit on the hand, with superior gripping capability, and further combines those superior functional characteristics with the ability to provide a glove which is attractively styled and comfortable to wear.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A sport glove or the like comprising (a) a highly elastic, contractile inner glove shell formed of a knitted fabric, (b) said inner glove shell being of an initial contracted size and being sufficiently elastic whereby upon insertion of the hand the inner glove will expand to cause the hand to be tightly confined to provide a tingling sensation while the hand is not constricted against required movements for use in sporting activities, (c) an outer glove shell completely surrounding and enveloping said inner shell, (d) means securing said inner and outer glove shells by substantial overall attachment of said outer shell to said inner shell enabling the assembled gloves to be donned and doffed as a unitary structure, (e) said outer glove shell being constructed of stretch materials which are much less elastic than the fabric of the inner shell, said materials permitting it to expand and contract and move together with the expansion and contraction of said highly elastic contractile inner glove shell and being of an initial contracted size substantially the same as the contracted size of said inner glove shell whereby upon insertion of the hand the inner glove shell will expand and the outer glove shell will stretch about the hand and upon removal of the hand from the inner glove shell, the outer glove shell will contract with the inner glove shell to the contracted size of the inner glove shell.

2. A sport glove or the like according to claim 1 wherein means for attachment of said outer shell to said inner shell is by stitching.

3. A sport glove or the like according to claim 1 wherein the means for attachment of said outer shell to said inner shell is by a bonding adhesive intermediate said outer and inner shells.

4. A sport glove or the like according to claim 1 wherein the outer surface of said inner shell includes hook-like projecting members and said outer shell is constructed to provide means in association with its inner surface cooperatively joining with said hook-like members to secure said outer and inner shells together.

* * * * *